US005222050A

United States Patent [19]

Marren et al.

[11] Patent Number: 5,222,050

[45] Date of Patent: Jun. 22, 1993

[54] WATER-RESISTANT TRANSDUCER HOUSING WITH HYDROPHOBIC VENT

[75] Inventors: Thomas F. Marren, Justice; Thomas F. Longwell, Lincolnshire, both of Ill.

[73] Assignee: Knowles Electronics, Inc., Itasca, Ill.

[21] Appl. No.: 900,662

[22] Filed: Jun. 19, 1992

[51] Int. Cl.[5] ..... H04R 17/00

[52] U.S. Cl. ..... 367/163; 367/167; 367/172; 367/174; 367/132; 181/132; 181/135; 381/154; 381/187

[58] Field of Search ..... 181/129, 132, 135, 137, 181/149, 198; 367/131, 132, 163, 167, 172, 174, 910; 405/193; 381/154, 187, 188, 189

[56] References Cited

U.S. PATENT DOCUMENTS

| | | | |
|---|---|---|---|
| 3,764,966 | 10/1973 | Abbagnaro | 367/910 X |
| 3,963,881 | 6/1976 | Fraim et al. | 367/181 X |
| 4,456,797 | 6/1984 | Olsen | 367/910 |
| 4,949,386 | 8/1990 | Hill | 381/188 |
| 4,987,597 | 1/1991 | Haerti | 381/69 |

OTHER PUBLICATIONS

"Effects of Sound Inlet Variations on Microphone Response"-TB3 Technical Bulletin by Knowles Electronics, Inc.

"EB Directional Hearing Air Microphone Application Notes"-TB21 Technical Bulletin by Knowles Electronics, Inc.

*Primary Examiner*—J. Woodrow Eldred

*Attorney, Agent, or Firm*—Wallenstein, Wagner & Harris, Ltd.

[57] ABSTRACT

An immersion-resistant housing adapted to receive a vibratable diaphragm spanning the interior of the housing to divide the housing into first and second chambers includes a first port communicating between the first chamber and the exterior environment. The first port is configured as a tubulation. A second port communicates between the second chamber and the external environment. The tubulation has sufficiently small diameter that water entering therein moves essentially as a piston without breakup. The tubulation is configured to have a volume at least equal to that of the first chamber, and a hydrostatic head of about 32 feet of water is necessary before water can be forced into the first chamber. In the preferred embodiment the diaphragm completely seals the housing against direct communication between the two chambers. Pressure equalization across the diaphragm under conditions of varying atmospheric pressure is achieved by a selective sealing system permitting passage of air through the second port while preventing the passage of water therethrough at pressures up to at least three and preferably ten meters of hydrostatic head.

31 Claims, 2 Drawing Sheets

WATER-RESISTANT TRANSDUCER HOUSING WITH HYDROPHOBIC VENT

TECHNICAL FIELD OF THE INVENTION

The technical field of the invention is water-immersible electrosonic transducers.

BACKGROUND PRIOR ART

In helicopter borne air-sea rescue operations, radio-equipped divers are frequently dropped into the water from a substantial height. For a diver to reach a depth of 3 meters below the surface of the water upon such an entry is a possible experience, and in exceptional cases depths of as much as 10 meters may be momentarily attained.

It is desirable that the earphone of the two-way radio communication unit be configured to be worn in the ear. Furthermore, any such earphone must be able to withstand at least momentary immersion, preferably to as much as 10 meters, and upon returning to the surface be immediately in serviceable condition. This requires that an in-the-ear earphone must be sealed against water entry, and must also provide adequate signal output once the earphone is no longer immersed. This requires some form of water entry barrier system to the interior of the earphone.

One approach to forming a barrier which is water-impermeable but sound permeable is disclosed in U.S. Pat. No. 4,987,597, issued to Haertl, Jan. 22, 1991. As disclosed therein, a membrane seal made of porous hydrophobic polytetrafluoroethylene is disposed to sealingly cover the output conduit of an in-the-ear hearing aid. The purpose of the membrane is to allow sound to pass through, but to reject any entry of perspiration. The hydrophobic property of the membrane prevents water from entering the pores of the structure; however, in the absence of water blockage, the membrane can successfully pass sound.

Attempts were made to employ this principle to a deep-immersion microphone. Similar membranes were affixed to the outlet conduits of in-the-ear hearing aid transducers. It was soon discovered that such a membrane, when made sufficiently stiff to successfully resist water at 10 meter immersion pressures, introduced an unacceptable degree of sound absorption. Alternative approaches using various forms of sealing diaphragms, either alone or in combination, resulted in structures that were either physically too large or insufficiently sound transmissive.

The present invention is oriented toward a solution of these and other problems.

SUMMARY OF INVENTION

An immersion-resistant housing adapted to receive a vibratable diaphragm spanning the interior of the housing to divide the housing into first and second chambers includes a first port communicating between the first chamber and the exterior environment. The first port is configured as a tubulation having an interior volume generally not less than the volume of the first chamber. The tubulation has sufficiently small diameter that water entering therein moves essentially as a piston without breakup. By configuring the tubulation to have a volume at least equal to that of the first chamber, a hydrostatic head of about 32 feet of water is necessary before water can be forced into the first chamber. In the preferred embodiment the diaphragm completely seals the housing against direct communication between the two chambers.

To allow for pressure equalization across the diaphragm under conditions of rapidly varying atmospheric pressure, a second port communicates between the second chamber and the external environment, and selective sealing means are provided for permitting passage of air through the second port while preventing the passage of water therethrough at pressures up to at least three and preferably ten meters of hydrostatic head. In the preferred form of the invention, this is accomplished by covering the second port with a hydrophobic membrane rendered porous by means of sub-micron diameter capillaries running therethrough. Air passes readily through the membrane, but considerable water pressure is necessary before water can enter. Additional strength is imparted to the structure by air-permeable anti-flexure screens disposed in confronting abutting relationship to opposite faces of the membrane.

The housing is equally well adapted to the protection of earphones (receivers) having a motor in the second chamber coupled to the diaphragm to cause sound to exit through the tubulation, or to microphones of, for example, the electrodynamic type having a generator similarly disposed and coupled. For the earphone embodiment an ear plug is provided configured to nestingly retain the housing in a passage in the plug with the tubulation oriented for insertion into the ear canal. The passage is configured to allow access of ambient air to the sealing means.

Other features and advantages of the invention will be evident from the specification to follow, the claims and the drawings.

DESCRIPTION OF THE INVENTION

Figure 1:
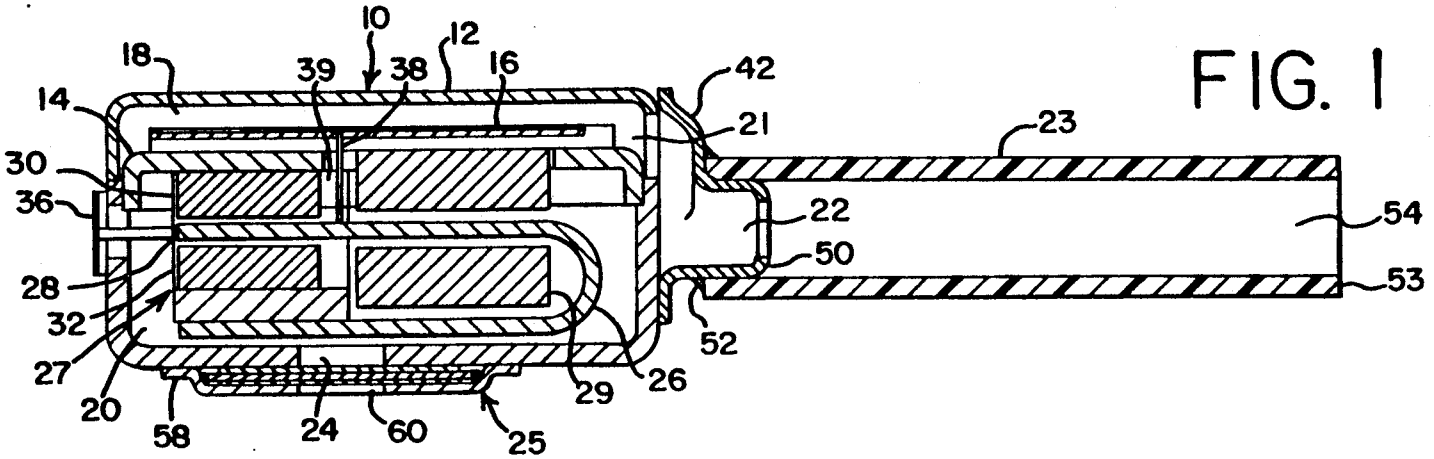
FIG. 1 is a cutaway side view of the inventive housing with a diaphragm and an earphone motor disposed therein.
Figure 2:
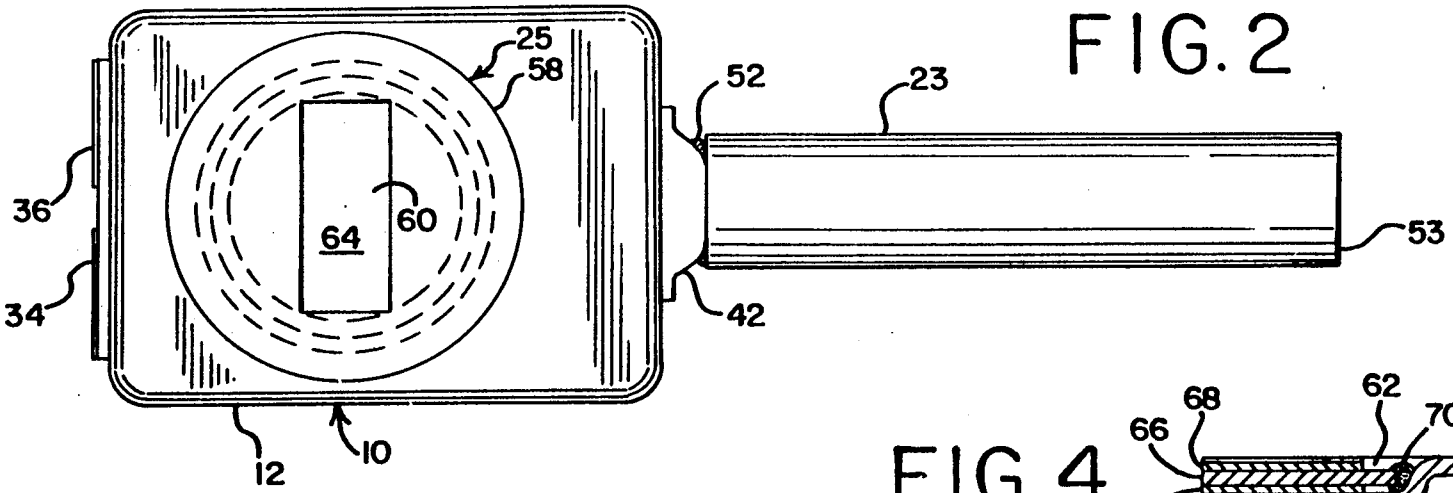
FIG. 2 is a bottom view of the housing shown in FIG. 1.

FIGS. 1 and 2 show an immersion-resistant earphone transducer assembly 10 specifically configured for use with a an earphone. The assembly 10 comprises a housing 12 having a partition wall 14 upon which is sealingly secured a flexible diaphragm 16. The diaphragm 16 divides the interior of the housing 12 into two independent chambers, namely an upper sound chamber 18 and a lower motor chamber 20. The lower motor chamber 20 contains an audio-frequency motor, to be discussed subsequently, which drives the diaphragm 16.

As is well known, sound produced by vibration of the diaphragm 16 exits the housing 12 via passages and passes along the interior of a tubulation 23. The interior volume of the tubulation 23 is preferably chosen to be approximately equal to the total interior volume of the sound chamber 18. Since the sound chamber 18 is completely sealed from the motor chamber 20, water entering the tubulation will not enter the sound chamber 18 until an immersion depth of approximately 32 feet is achieved.

To accommodate rapid change in ambient atmospheric pressure, such as during rapid climb or descent of the helicopter, a passage 24 in the motor chamber wall communicates with a selective seal system 25 which passes air freely, but which prevents entry of water when immersed.

In more detail, a generally U-shaped armature 26 disposed within the motor chamber 20 has one end fixedly secured to a permanent magnet structure 27. The free end 28 of the armature 26 passes through a solenoid drive coil 29 and between confronting pole pieces 30, 32 of the permanent magnet structure 27. The solenoid drive coil 29 is excited by electrical signals applied to external terminals 34, 36. The resulting magnetization of the armature 26 causes the free end 28 of the armature 26 to oscillate, this motion being coupled to the diaphragm 16 by means of a coupling rod 38 moving within a passage 39 in the partition wall 14. The sound chamber 18 is provided with a sound outlet passage 21 at one end. The sound produced by vibrations of the diaphragm 16 are thus transmitted outside of the housing 12 through the passage 21. An outlet chamber 42 is provided mounted on one end of the housing 12 and is sealed in communication with the passage 21. The outlet chamber 42 has an exterior passage 22. The outer end 50 of the outlet chamber 42 is generally cylindrical, and the tubulation 23 is press-fitted in place, to be secured in place by a fillet 52 of an appropriate bonding agent, such as self-vulcanizing silicone. In the preferred embodiment, the tubulation 23 is made of polytetrafluoroethylene, principally because of its ease of cleaning. Sound originating in the sound chamber 18 will thus ultimately emerge from the outer end 53 of the tubulation 23.

In the particular transducer assembly 10 shown, the housing 12 exclusive of the outlet chamber 42 is approximately 0.350" (8.9 millimeters) in length. The volume of the sound chamber 18 is approximately 18 cubic millimeters. The tubulation 23 has an interior diameter of 1.5 millimeters and a length of approximately 10.2 millimeters, and thus has a volume of approximately 18 cubic millimeters. It will therefore be appreciated that as the transducer assembly 10 is immersed in water to increasing depth, two things will happen.

First, because of the small interior diameter of the tubulation 23, water entering the tubulation will, because of surface tension affects, move essentially as a continuous piston towards the housing. Since the volume of the tubulation 23 and the interior volume of the sound chamber 18 are equal it follows that, irrespective of what the atmospheric pressure was prior to immersion, the plug of water entering the passage 54 will not reach the passage 21 leading to the sound chamber 18 until the total pressure of water (atmospheric pressure plus hydrostatic head) equals two atmospheres. Thus there must be one atmosphere of hydrostatic head for this to occur, corresponding to an immersion depth of approximately 32 feet (9.7 meters). Upon return to the surface, the water in the passage 54 will immediately be expelled.

In prior art transducer assemblies, the motor chamber 20 communicates with the sound chamber 18 by means of a small aperture in the diaphragm 16. This venting is done so that variations in ambient pressure communicated to the sound chamber from the external environment as well as changes in the temperature within the motor chamber 20 do not induce distortion-producing offsetting of the diaphragm 16. The purpose of such a passage is provide a slow leakage between the two chambers 18, 20 so as to maintain equal static pressure on opposite sides of the diaphragm 16. The transducer assembly 10 of the present invention must be able to accommodate extremely rapid changes in atmospheric pressure. A small diaphragm passage will not accommodate such rapid variations in air pressure, and if a diaphragm passage were configured with sufficient area to accommodate such rapid pressure variations, then the motor chamber 20 would effectively be in communication with the sound chamber 18, thus raising the effective interior volume by more than an order of magnitude. The tubulation 23 in such a case would have to be made so long as to be useless.

Accordingly, in the preferred form of the invention, the diaphragm 16 has no aperture passing therethrough and ambient pressure equalization in the motor chamber 20 is achieved by means of the passage 24 in one face of the motor chamber 20 covered by a seal system 25 which allows the free flow of air into and out of the motor chamber, but which is impervious to water.

Figure 4:
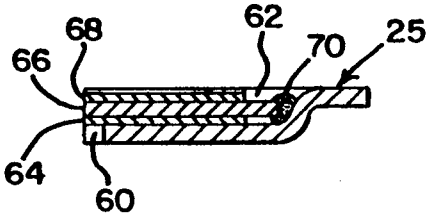
FIG. 4 is a detail view of a portion of the assembly shown in exploded form in FIG. 3.
Figure 3:
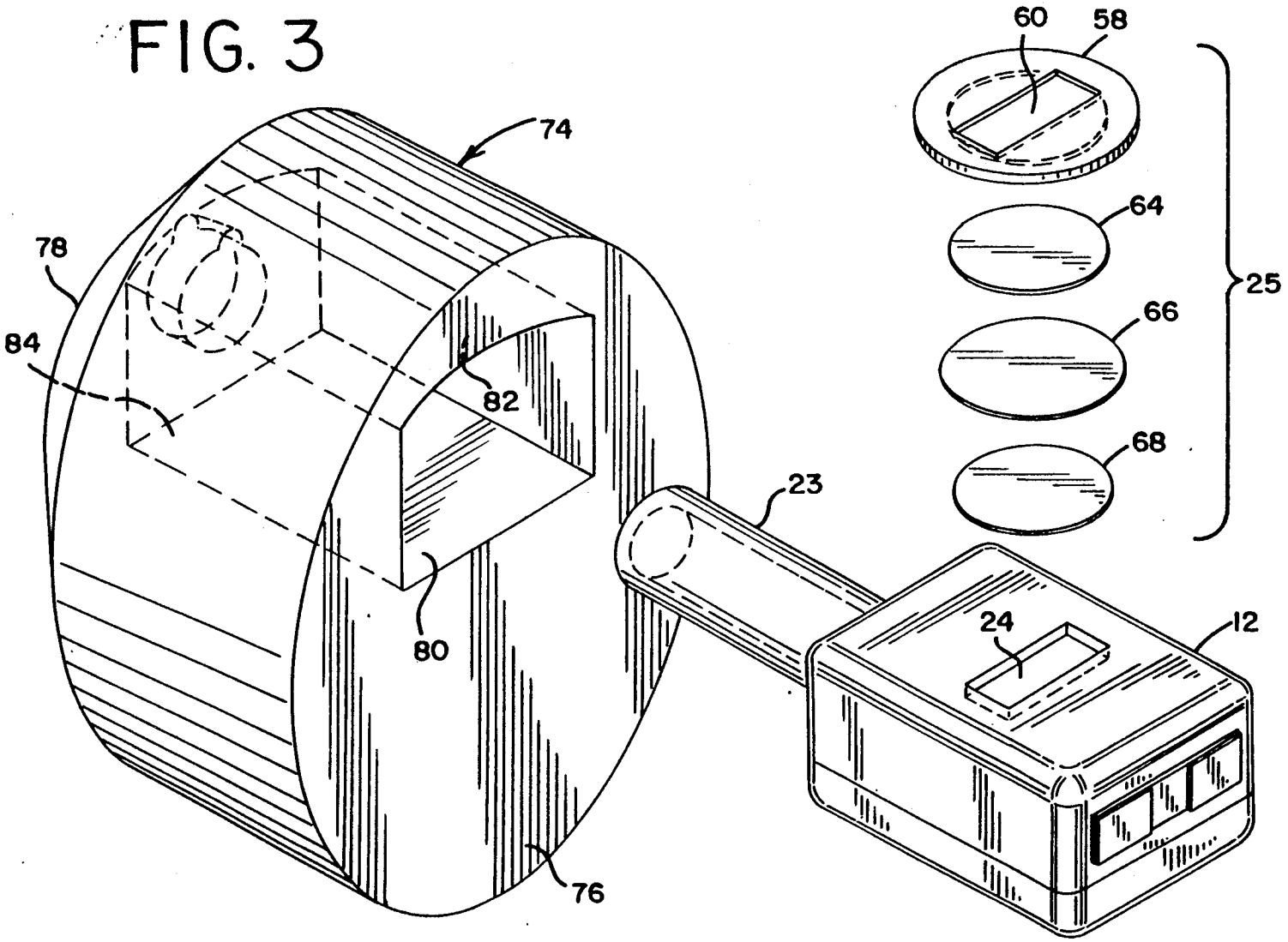
FIG. 3 is a partially exploded view of the housing and an associated earplug.

Considering the seal system 25 in more detail and with particular reference to FIGS. 3 and 4, the passage 24 communicating with the motor chamber 20 has a rectangular configuration. A circular seal cap 58 has a corresponding rectangular passage 60 passing through the central portion thereof. A shallow well 62 is provided in the seal cap and in this well are emplaced sequentially a stiffener screen 64, a permeable membrane 66, and another stiffener screen 68. The periphery of the permeable membrane 66 is secured to the walls of the well 62 by a fillet 70 of a suitable water-proof cement. The entire assembly is then emplaced over the passage 24 in the housing 12, and the seal cap 58 is hermetically sealed thereto, as for example, by laser seam welding.

The particular material used for the permeable membrane is porous polytetrafluoroethylene film marketed under the name Tetratex by the Tetratec Corporation of Feasterville, Pa., U.S.A. This membrane has a thickness of 0.0015" (0.038 millimeters) and an effective pore size of 0.22 microns. Since the material from which it is made is hydrophobic, water is effectively barred from entry through the pores. On the other hand, the air flow rate is greater than 5 cubic centimeters per square centimeter of membrane at a pressure differential of 9 millimeters of mercury. Seal system 25 provides adequate venting during rapid variation of atmospheric pressure, and also serves to prevent entry of water into motor chamber 20 attendant to 10 meter immersion.

FIG. 3 also shows an ear plug 74 to be used in conjunction with the transducer assembly 10 when it is configured as an earphone (receiver). The ear plug 74 is preferably of soft elastomeric material such as silicone rubber, and is generally cylindrical, having a generally planar outer face 76 and an inner face 78 adapted to conform to the contours of the ear in the vicinity of the ear canal. A first passage 80 is configured to insertingly accept the lateral dimensions of the housing 12. The ceiling 82 of the passage 80 has an arcuate shape to allow pneumatic communication to the passage 60 of the seal cap 58. A second passage 84 communicates between the inner end 78 of the ear plug 74 and the inner end of the passage 80, and is configured to insertingly accept the tubulation 23 of the transducer assembly 10 to extend into the ear canal. An optional sealing-type slide-on ear plug (not shown) conformed to seal into the ear canal may optionally be provided.

While the invention has been described with reference to a preferred embodiment, it will be understood by those skilled in the art that various changes may be made and equivalents may be substituted for elements thereof without departing from the broader aspects of the invention. Thus, the housing is equally well adapted to the protection of earphones (receivers) having a motor in the second chamber coupled to the diaphragm to cause sound to exit through the tubulation, or to microphones of, for example, the electrodynamic type having a generator similarly disposed and coupled.

Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

We claim:

1. In an immersion-resistant housing adapted to receive a vibratable diaphragm spanning the interior of said housing and dividing said housing into first and second chambers of given volumes sealed from interior pneumatic communication with each other, and including a first port communicating between said first chamber and the exterior environment, the improvement comprising:

said first port configured as an extended tubulation open to fluid and sonic flow, said tubulation having a cross-sectional dimension sufficiently small that water forced into said tubulation from said exterior environment by immersion will travel as a homogeneous plug without breakup;

a second port communicating between said second chamber and the external environment; and selective sealing means for permitting passage of air through said second port while preventing the passage of water therethrough.

2. The housing of claim 1 wherein said sealing means includes means for preventing the passage of water therethrough at pressures up to at least three meters of hydrostatic head.

3. The housing of claim 1 wherein said sealing means includes a planar membrane of hydrophobic material having a plurality of capillary air passages extending therethrough.

4. The housing of claim 3 wherein said sealing means includes first and second planar screens disposed in confronting abutting relationship to opposite faces of said hydrophobic membrane.

5. The housing of claim 4 including an earplug having first and second generally opposing outer surfaces and configured for emplacement into the exterior portion of a user's ear, said earplug including a first passage communicating with said first surface and configured to insertingly accept said housing and a second passage communicating between said second surface and said first passage and configured to insertingly accept said tubulation to project beyond said second surface and into a user's ear canal, said first passage being configured to provide fluid communication between said sealing means and said first surface.

6. An immersion-resistant audio frequency transducer comprising:

a housing;

a vibratable diaphragm spanning the interior of said housing and dividing said housing into a first chamber and a second chamber of given volumes sealed from interior pneumatic communication with each other;

one of an audio frequency motor and an audio frequency generator disposed within said second chamber and coupled to said diaphragm;

a first port communicating between said first chamber and the exterior environment, said outlet port being configured as an elongated tubulation open to fluid and sonic flow, said tubulation having an inner cross-sectional dimension sufficiently small that water forced into said tubulation from said exterior environment by immersion will travel as a homogeneous plug without breakup, said tubulation having an interior volume generally not less than one half the volume of said first chamber;

a second port communicating between said second chamber and the external environment; and selective sealing means for permitting passage of air through said second port while preventing the passage of water therethrough at pressures up to at least three meters of hydrostatic head.

7. The transducer of claim 6 wherein said sealing means includes a planar membrane of hydrophobic material having a plurality of capillary air passages extending therethrough.

8. The transducer of claim 7 wherein said sealing means includes first and second planar screens disposed in confronting abutting relationship to opposite faces of said hydrophobic membrane.

9. The transducer of claim 8 including an earplug having first and second generally opposing outer surfaces and configured for emplacement into the exterior portion of a user's ear, said earplug including a first passage communicating with said first surface and configured to insertingly accept said housing and a second passage communicating between said second surface and said first passage and configured to insertingly accept said outlet port tubulation to project beyond said second surface and into a user's ear canal, said first passage being configured to provide fluid communication between said seal and first surface, said transducer being a motor for exciting vibrations in said diaphragm responsively to electrical signals applied to said motor.

10. An immersion-resistant audio frequency transducer comprising:

a housing;

a vibratable diaphragm spanning the interior of said housing and dividing said housing into a first chamber and a second chamber of given volumes sealed from interior pneumatic communication with each other;

one of an audio frequency motor and an audio frequency generator disposed within said second chamber and coupled to said diaphragm;

a first port communicating between said first chamber and the exterior environment, said first port being configured as an elongated tubulation open to fluid and sonic flow, said tubulation having an inner cross-sectional dimension sufficiently small that water forced into said tubulation from said exterior environment by immersion will travel as a homogeneous plug without breakup, said tubulation having an interior volume generally not less than one half the volume of said first chamber;

a second port communicating between said second chamber and the external environment;

a selective seal disposed sealingly across said second port, said seal including a planar membrane of hydrophobic material having a plurality of capillary air passages extending therethrough so as to be air-permeable but impermeable to water; and first and second planar screens disposed in confronting abutting relationship to opposite faces of said hydrophobic membrane.

11. The transducer of claim 10 wherein said selective seal includes a means for preventing the passage of water therethrough at pressures up to at least five meters of hydrostatic head.

12. The transducer of claim 10 including an earplug having first and second generally opposing outer surfaces and configured for emplacement into the exterior portion of a user's ear, said earplug including a first passage communicating with said first surface and configured to insertingly accept said housing and a second passage communicating between said second surface and said first passage and configured to insertingly accept said sound port tubulation to project beyond said second surface and into a user's ear canal, said first passage being configured to provide fluid communication between said seal and first surface, said transducer being a motor for exciting vibrations in said diaphragm responsively to electrical signals applied to said motor.

13. The housing of claim 1 wherein said tubulation has an interior volume generally not less than one half the volume of said first chamber.

14. The housing of claim 13 wherein said tubulation has an interior volume approximately equal to that of said first chamber.

15. The housing of claim 2 wherein said sealing means includes a means for preventing the passage of water therethrough at pressures up to at least ten meters of hydrostatic head.

16. The transducer of claim 6 wherein said tubulation has an interior volume approximately equal to that of said first chamber.

17. The transducer of claim 6 wherein said sealing means includes a means for preventing the passage of water therethrough at pressures up to at least ten meters of hydrostatic head.

18. The transducer of claim 10 wherein said tubulation has an interior volume approximately equal to that of said first chamber.

19. The transducer of claim 10 wherein said selective seal includes a means for preventing the passage of water therethrough at pressures up to at least ten meters of hydrostatic head.

20. The transducer of claim 6 wherein said one of an audio frequency motor and an audio frequency generator is an audio frequency generator.

21. The transducer of claim 10 wherein said one of an audio frequency motor and an audio frequency generator is an audio frequency generator.

22. The housing of claim 13 wherein said sealing means includes a means for preventing the passage of water therethrough at pressures up to at least three meters of hydrostatic head.

23. The housing of claim 22 wherein said sealing means includes a means for preventing the passage of water therethrough at pressures up to at least ten meters of hydrostatic head.

24. The housing of claim 13 wherein said sealing means includes a planar membrane of hydrophobic material having a plurality of capillary air passages extending therethrough.

25. The housing of claim 24 wherein said sealing means includes first and second planar screens disposed in confronting abutting relationship to opposite faces of said hydrophobic membrane.

26. The housing of claim 25 including an earplug having first and second generally opposing outer surfaces and configured for emplacement into the exterior portion of a user's ear, said earplug including a first passage communicating with said first surface and configured to insertingly accept said housing and a second passage communicating between said second surface and said first passage and configured to insertingly accept said tubulation to project beyond said second surface and into a user's ear canal, said first passage being configured to provide fluid communication between said sealing means and said first surface.

27. The housing of claim 14 wherein said sealing means includes a means for preventing the passage of water therethrough at pressures up to at least three meters of hydrostatic head.

28. The housing of claim 27 wherein said sealing means includes a means for preventing the passage of water therethrough at pressures up to at least ten meters of hydrostatic head.

29. The housing of claim 14 wherein said sealing means includes a planar membrane of hydrophobic material having a plurality of capillary air passages extending therethrough.

30. The housing of claim 29 wherein said sealing means includes first and second planar screens disposed in confronting abutting relationship to opposite faces of said hydrophobic membrane.

31. The housing of claim 30 including an earplug having first and second generally opposing outer surfaces and configured for emplacement into the exterior portion of a user's ear, said earplug including a first passage communicating with said first surface and configured to insertingly accept said housing and a second passage communicating between said second surface and said first passage and configured to insertingly accept said tubulation to project beyond said second surface and into a user's ear canal, said first passage being configured to provide fluid communication between said sealing means and said first surface.

* * * * *